United States Patent [19]

Eck

[11] 4,170,936

[45] Oct. 16, 1979

[54] METHOD FOR REMOVING WASTE

[75] Inventor: Walter Eck, Munich, Fed. Rep. of Germany

[73] Assignee: Bosch-Siemens Hausgerate GmbH, Munich, Fed. Rep. of Germany

[21] Appl. No.: 737,012

[22] Filed: Oct. 29, 1976

Related U.S. Application Data

[60] Continuation of Ser. No. 373,915, Jun. 27, 1973, which is a division of Ser. No. 263,851, Jun. 19, 1972, abandoned.

[30] Foreign Application Priority Data

Jun. 8, 1971 [DE] Fed. Rep. of Germany ..... 2130230
Jun. 18, 1971 [DE] Fed. Rep. of Germany ..... 2130231

[51] Int. Cl.[2] ..... B30B 9/04
[52] U.S. Cl. ..... 100/39; 100/91; 241/24
[58] Field of Search ..... 241/24, 81, 68, 227, 241/229, 293, 60, 62, 101.2, 143, 44; 209/106, 115; 83/39, 70; 100/35, 229 R, 39, 102, 91, 94, 70, 71

[56] References Cited

U.S. PATENT DOCUMENTS

| | | | |
|---|---|---|---|
| 211,179 | 1/1879 | Peters | 241/227 X |
| 2,059,229 | 11/1936 | Gregg | 100/39 |
| 2,105,759 | 1/1938 | Stevenson | 241/60 X |
| 2,594,054 | 4/1952 | McNamara | 100/91 |
| 3,363,847 | 1/1968 | Joa | 241/81 |
| 3,537,390 | 11/1970 | Hinkel | 100/229 R |
| 3,547,577 | 12/1970 | Lovercheck | 100/70 |
| 3,604,179 | 9/1971 | Lund | 100/39 |
| 3,604,345 | 9/1971 | Boje | 100/71 |

FOREIGN PATENT DOCUMENTS

| | | | |
|---|---|---|---|
| 1244682 | 7/1967 | Fed. Rep. of Germany | 100/233 |

*Primary Examiner*—Billy J. Wilhite
*Attorney, Agent, or Firm*—Kenyon & Kenyon

[57] ABSTRACT

A method for discharging waste materials, such as household refuse, into a central sewage system. Prior to discharge, at least a portion of the waste products are crushed and stored in a container which container is connected to the sewage system by a pipe coupling which includes a solenoid valve controlled either by means of a timing clock or from a central control station. In the latter situation, the solenoid valve is activated preferably by a medium frequency signal generated at the station.

1 Claim, 3 Drawing Figures

Fig. 2.
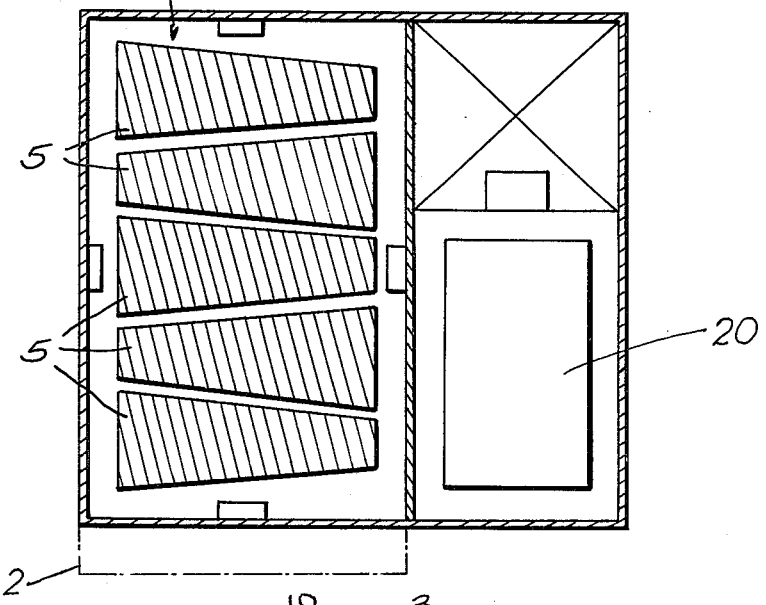
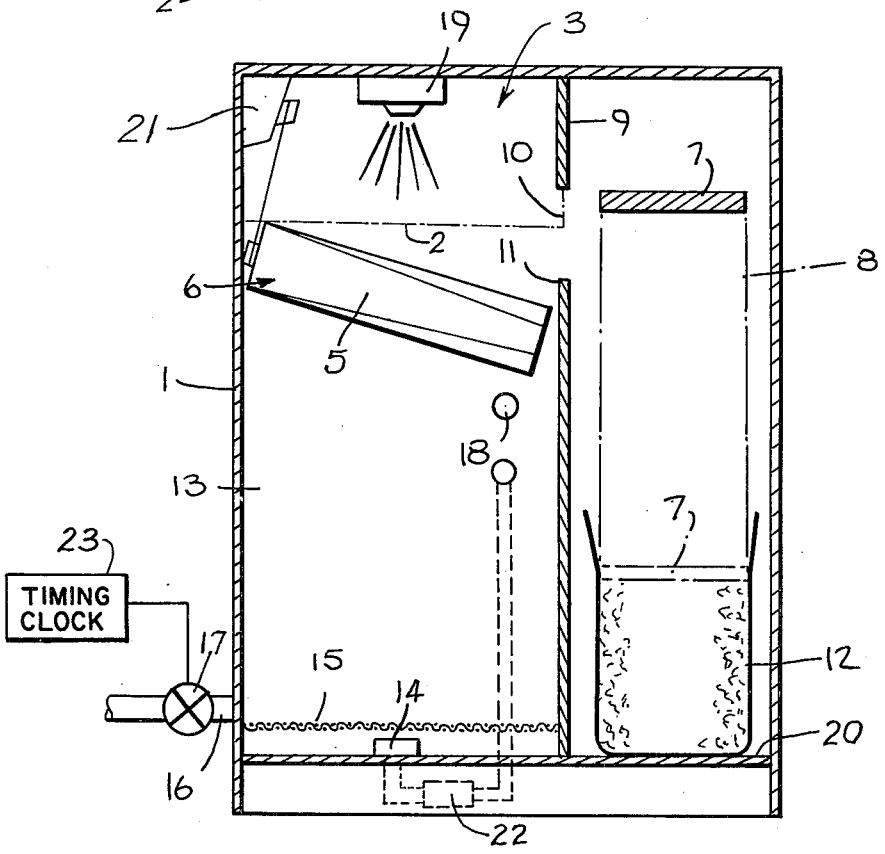
Fig. 3.

METHOD FOR REMOVING WASTE

This is a continuation of application Ser. No. 373,915, filed June 27, 1973, which is a division of application Ser. No. 263,851, filed June 19, 1972, now abandoned.

BACKGROUND OF THE INVENTION

This invention relates generally to a method for removing waste materials and more particularly to one wherein waste materials such as those typically generated in a household are disposed of through available sewage systems at predetermined intervals.

It is heretofore known to use different types of waste disposal systems, some of which are connected to sewage systems or the like. This type of system generally processes the waste materials during conventional meal periods, namely during the morning, noon and early evening hours associated with the typical eating time in the locale. Accordingly, the waste is introduced into the sewer system simultaneously by many of the residents in the area such that the system becomes heavily overburdened. In order to alleviate this problem certain municipal authorities have prohibited or limited the usage of such waste disposal systems because of the inability of the available sewage systems to accommodate these appliances.

By the means disclosed herein, a method is provided wherein waste products generated in the household can be disposed without overburdening the available sewage systems. Furthermore, the method of this invention provides for an effective disposal of certain waste products into the sewage system while those that cannot readily be accommodated therein are segregated and disposed of elsewhere.

SUMMARY OF THE INVENTION

Briefly stated, in the method provided herein the waste products are placed in a disposal apparatus and passed onto a grinding means disposed adjacent thereto. The grinding means includes a plurality of rotatable members which are spaced from one another so that the waste products are ground and crushed between adjacent members and dropped therebeneath. Beneath the rotatable members is a container adapted to receive and hold the crushed waste materials until they are ready for ultimate disposal. A coupling is provided which connects the container means to a central disposal or sewage system into which the waste materials are discharged from the apparatus. Further, means are provided for opening and closing the coupling means so as to allow for the discharge of the waste material at predetermined intervals.

Reference is made to the applicant's copending application entitled Apparatus for Removing Waste Material, Ser. No. 263,852, now U.S. Pat. No. 3,807,296, filed on even date herewith, for a further description of the apparatus used in conjunction with the invention.

In a more specific embodiment, the rotatable members are inclined away from the introducing means and have adjacent their lowermost end a second container means. A partition which extends slightly above the lowermost portion of the inclined rotatable members is provided between the two container means. In this manner, the waste constituents which are not crushed by the rotatable members are passed to the second container which is provided with a die press adapted to compact those waste materials deposited therein. Preferably the rotatable members are cone shaped and positioned such that the larger diameter is adjacent the smaller diameter of the member cooperating therewith. Furthermore, it is preferable to have a means for introducing water into the container so that the biologically decomposable waste constituents can be floated while awaiting discharge into the sewage system. The water is preferably waste water which is recirculated in the container or it may be fresh water introduced from an outside source.

The method of the invention includes the introduction of the waste material into the apparatus, which material is then separated into basically two classes. One is of a type which can be readily crushed between rotating members and is readily decomposable while the other is generally of a bulk non-biologically decomposable type such as glass bottles, metallic materials or the like. The readily crushable decomposable constituent of the waste material is crushed by rotatable members and passed into a container where it is held until ready for discharge into the sewage system. Preferably this constituent of the waste is floated in water during the holding period. The remaining constituents of the waste product are passed to a second container and stored within a bag which is compressed or compacted when full and disposed of by other means. The material to be discharged into the sewage systems is introduced automatically at a predetermined time so as not to overburden the available sewage systems. This may either be accomplished from a central control station or by allocating certain disposal times to different neighborhoods.

Accordingly, it is an object of this invention to provide a method for disposing waste materials into available sewage systems without unduly burdening the system.

It is another object of this invention to provide a simple and effective waste disposal method wherein the waste materials are separated into those which can be accepted by available sewage systems and which are discharged therein at predetermined intervals.

The objects of this invention are accomplished by crushing the refuse and then storing it in a container which is connected to a sewage system. The container is discharged into the sewage system at a predetermined time either individually or in groups which may also be accomplished from a central control station. The method of the invention further makes it possible to dispose of waste materials through a sewer system during periods when the system is somewhat inactive or not heavily used. For instance, the late night and early morning hours between 10.00 P.M. and 6.00 A.M. are most preferred since the sewage system at that time does not receive any great deal of material. By the means disclosed herein, it is also possible to control the discharge of waste material dependent on the respective loads of the sewer networks. While the refuse material is being held for discharge into the sewage system, it is preferred to float the wastes stored in the containers. This can be accomplished either by the introduction of fresh water or preferably with waste water which is at least partially recirculated in the container.

In another feature of this invention, bulk waste materials which are resistent to biological decomposing are not introduced into the sewage system since prior to discharge they are separated and those materials which are readily crushable and decomposable are introduced into the sewage system. This separation is accomplished by the crushing means provided. In addition to relieving the sewage treatment or filtering plants of this problem, the separation step provides an opportunity to deliver the wastes consisting of the non-biologically decomposable materials to appropriate treatment installations for possible further use.

These and other objects, advantages and features of the invention will become more apparent from the following description taken in conjunction with the accompanying drawings.

BRIEF DESCRIPTION OF THE DRAWINGS

FIG. 2 is a top cross-sectional view of the apparatus taken along the line II—II of FIG. 1; and FIG. 3 is an elevation view partially in cross-section of the apparatus of FIG. 1 with the front panel removed.

DESCRIPTION OF THE PREFERRED EMBODIMENT

Figure 1:
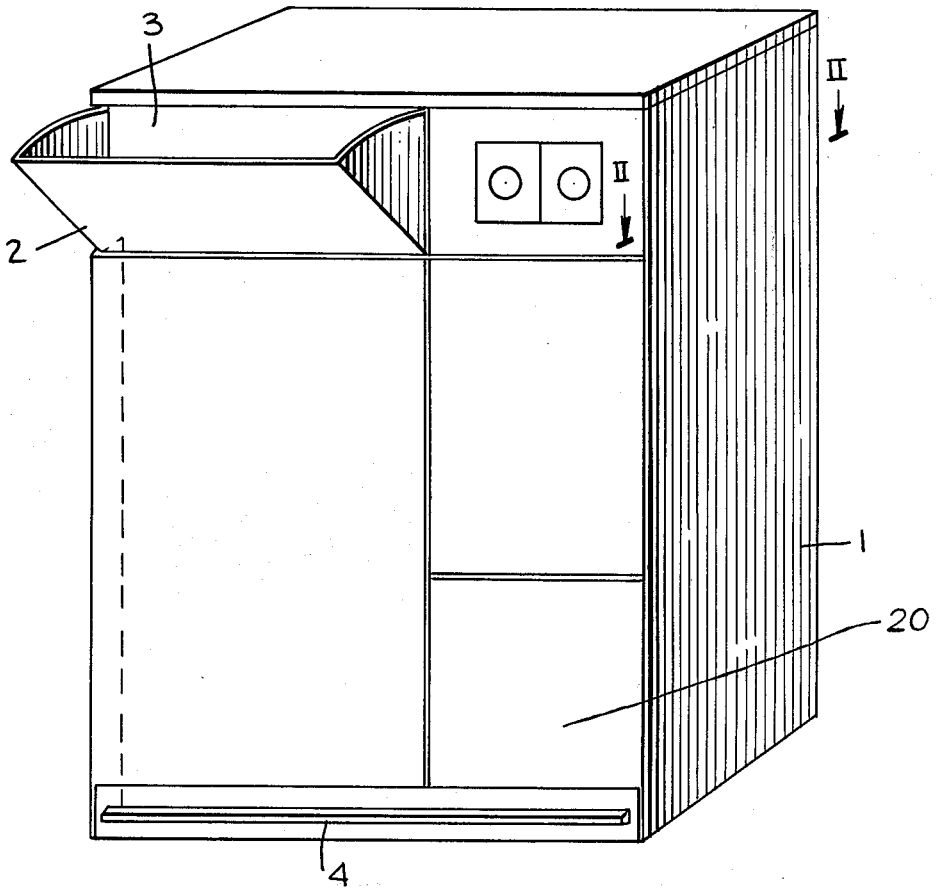
FIG. 1 is a perspective view of an apparatus utilized for carrying out the method invention.

With reference to the drawings, the waste disposal unit 1 includes on the front panel a hinged chute 2 which has an opening 3 and is operable by means of a floor switch 4 connected thereto by means of an appropriate linkage. The waste materials introduced into the chute opening 3, pass to a sorting chamber which has at its lower portion crushing or grinding equipment 6. The crushing or grinding equipment 6 includes a plurality of tapered cones 5, the illustrated number being five, which are inclined away from the chute opening 3. In this manner, bulky items as well as those items which are not readily biologically decomposable will move along the inclined surface of the cones 5 and over the gate edge 11 of partition 9 through the opening denoted as 10. This bulk material then passes into another container or chamber 8 where the material is crushed or compacted by the descending press 7. The bulk material is compressed or compacted into a pile which is within a bag 12 so that easy removal from the compression chamber 8 may be accomplished. The lower portion of chamber 8 is designed in the manner of a drawer 20 to allow for ready removal of the compacted waste.

The tapered cones are positioned adjacent one another in the manner illustrated in FIG. 2, namely the larger diameter is positioned adjacent to the smaller diameter of the adjacent cone. Spacing between the cones 5 is such that the material is appropriately crushed when the cones are rotated. The cones are rotatably driven by an electric motor 21 coupled thereto by means of a belt drive system. The constituents of the waste material which can be crushed or ground passes through the cones 5 into the container or collecting tank 13 disposed therebeneath.

At the lower portion of collecting tank 13, is a freshwater inlet 14 controlled by a valve (not shown). Above inlet 14 is a distribution screen 15 extending over the entire bottom area of the collecting tank 13. In the upper region of the collecting tank 13, is an overflow pipe 18 which is connected into the discharge line 16 downstream of the outlet valve 17. A disinfectant dispenser 19 is also provided above the grinder 6.

The garbage inserted in the opening 3 first arrives at the grinding cones 5 of the grinder 6 which are inclined toward the compacting chamber 8 and which pick up and comminute the easily decomposable components of the garbage which as a rule consist of organic substances while the garbage consisting of components which are not or only slightly decomposable, such as for instance, bottles, cans and the like, is carried from the grinding cones 5 through the connecting opening 10 over the gate 11 into the press chamber 8. Prior to or during this process, the garbage is treated with disinfectant from the disinfectant dispenser 19. The garbage crushed by the grinder 6 passes into the collecting tank 13, in the bottom region of which a water sump is situated. At a predetermined time or through a remote control signal, fresh water is first fed into the collecting tank 13 via the fresh water inlet 14, so that the garbage sludge that has settled at the bottom is flushed upwardly. Subsequently, the valve 17 is opened and the contents of the collecting tank 13 are carried into the existing sewer system via the discharge line 16.

In a garbage disposal system which is designed to receive waste water, the fresh water connection may be omitted. In its place is the pressure line of the circulating pump 22 the intake line of which is connected to the upper portion of the collecting tank 13 at a point below the opening of the overflow pipe 18. The garbage that has settled at the bottom of the collecting tank 13 is flushed upwardly in this case by the waste water delivered by the circulating pump. The garbage arriving in the press chamber 8 is compressed in the customary manner by the compacting press 7 and can be removed from the drawer 12 as a convenient compact package.

Pipe connection 16 includes valve 17 which is a solenoid type valve controllable either by a timing clock 23 or signals from a central control station. In the latter situation, the signals are preferably superimposed on the frequencies of the available power supply systems. Prior to discharge of the waste materials from container 13, the crushed waste stored therein is preferably floated either by circulating the waste water which is also contained in the container 13 or by introducing additional fresh water. Once the valve 17 is open, the waste mixed with water is introduced via connecting line 16 into the sewage system while the discharge time can be adjusted for the respective station and particularly with respect to the loading of the local sewer network.

Although the above description is directed to a preferred embodiment of the invention, it is noted that other variations and modifications will be apparent to those skilled in the art and, therefore, may be made without departing from the spirit and scope of the present disclosure.

What is claimed is:

1. A method of disposing of household wastes into a central receiving system at predetermined intervals which comprises the steps of:

introducing household wastes into a disposal apparatus, separating readily crushable non-bulky decomposable and non-decomposable constituents from bulk decomposable and non-decomposable constituents of said household wastes in said apparatus, passing said separated non-bulky waste constituents to a separate container means in said apparatus, passing said bulk constituents of said household wastes to a separate container means and compressing said constituents into a bag for disposal upon reaching a predetermined level in said container means, holding the separated non-bulky constituents for discharge in said container means in said apparatus until a predetermined time, introducing water into said container means in which the separated non-bulky constituents are held for discharge so as to float said constituents in said container means during said holding, generating a signal in response to a timing means, said apparatus including means responsive to said signal for discharging said separated non-bulky constituents from said apparatus into a central receiving system, and discharging the separated non-bulky constituents from said apparatus into said central receiving system at a predetermined time.

* * * * *